United States Patent [19]

Hall et al.

[11] 4,079,614

[45] Mar. 21, 1978

[54] METHOD AND APPARATUS FOR FLANGING A LENGTH OF SPIRALLY WOUND CORRUGATED PIPE

[75] Inventors: Robert E. Hall, Newport Beach; Clyde Lamar, West Sacramento, both of Calif.

[73] Assignee: W. E. Hall Co., Irvine, Calif.

[21] Appl. No.: 762,385

[22] Filed: Jan. 26, 1977

Related U.S. Application Data

[63] Continuation-in-part of Ser. No. 598,173, Jul. 23, 1975, Pat. No. 4,008,592.

[51] Int. Cl.[2] ..... B21D 19/04

[52] U.S. Cl. ..... 72/72; 72/110; 72/465; 72/DIG. 14

[58] Field of Search ..... 72/70, 71, 72, 110, 72/465, DIG. 14, 105, 106

[56] References Cited

U.S. PATENT DOCUMENTS

| | | | |
|---|---|---|---|
| 1,930,562 | 10/1933 | Krueger | 72/DIG. 14 |
| 2,182,401 | 12/1939 | Kreis et al. | 72/106 |
| 2,239,696 | 4/1941 | Bohm | 72/70 |
| 2,809,687 | 10/1957 | Ogle | 72/105 |
| 3,548,623 | 12/1970 | Hess et al. | 72/106 |
| 3,648,503 | 3/1972 | Harper | 72/110 |

*Primary Examiner*—Lowell A. Larson
*Attorney, Agent, or Firm*—Lyon & Lyon

[57] ABSTRACT

Disclosed herein is an assembly for forming a radial end flange upon a length of spirally wound corrugated metal pipe. The assembly includes a head stock having a pair of rotatably driven rollers for turning the length of pipe to be flanged and initiating the flange, an ironing wheel mounted perpendicularly with respect to the axis of the rollers for completing the flange, and a shearing wheel associated with one of the flanging rollers for removing excess metal from the formed end flange. The assembly also includes a tail stock having upper and lower support rollers for assisting in the turning of the pipe length and for securing supporting the other end of the pipe and a center turntable support for positioning the length of pipe to be flanged.

22 Claims, 13 Drawing Figures

METHOD AND APPARATUS FOR FLANGING A LENGTH OF SPIRALLY WOUND CORRUGATED PIPE

This is a continuation-in-part of the co-pending parent application, Ser. No. 598,173, filed July 23, 1975 and entitled Method and Apparatus for Flanging a Length of Spirally Wound Corrugated Pipe, now U.S. Pat. No. 4,008,592.

BACKGROUND OF THE INVENTION

Corrugated metal pipe is widely used for underground drains, culverts and other pipelines. To facilitate pipe construction and flexibility, such pipe is often helically wound wherein the corrugations and lock or welded seam extend helically around and along the length of pipe. In the trade, such pipe is termed either spirally or helically wound corrugated pipe. In laying a pipeline comprised of such pipe, the lengths of pipe after forming are taken to the job site where they are joined together by large split bands having spiral or helical corrugations which bands are placed about the juncture of butting or overlapping adjacent pipe lengths. Brackets are secured to the ends of the split bands which are drawn together by bolts extending between the brackets, thereby forming a seal between adjacent pipe lengths.

Another method of forming a pipeline from pipe lengths having annular — not spiral — corrugations is to flare the ends of the individual lengths of pipe outwardly to form an end flange prior to transporting the lengths of pipe to the job site. Pipe with annular corrugations costs more to manufacture than pipe with spiral corrugations, but it can easily be provided with an end flange. At the job site, these flanged pipe lengths are then joined together by channel band couplers, such as that described in applicant's co-pending U.S. patent application, Ser. No. 428,263. While methods and apparatus have been developed by applicant for flanging a length of pipe having annular corrugations, such methods and apparatus are not suited for flanging a length of spirally wound corrugated pipe. Accordingly, the superior channel type coupler was not compatible with spirally wound corrugated pipe until the development of the method and apparatus for flanging a length of spirally corrugated pipe which is the subject of the parent application, Ser. No. 598,173.

SUMMARY OF THE INVENTION

Briefly, the invention comprises an assembly for forming a radial end flange upon a length of spirally wound corrugated metal pipe. The assembly includes a pair of rollers which rotate the pipe and initiate the formation of a flange and, depending on the configuration of the rollers, can apply annular corrugations to the end of the spirally wound pipe. After the flange is initially formed, an ironing wheel is activated to press the flange into a perpendicular disposition with respect to the longitudinal axis of the length of pipe and a shearing wheel is employed to remove the excess metal from the formed flange. Central and rear supports are provided to secure and support the length of pipe as the flange is formed thereon.

It is the principal object of the present invention to provide an apparatus for forming a radial end flange upon a length of spirally wound corrugated metal pipe.

This and other objects and advantages of the present invention will become apparent from the following detailed description taken in conjunction with the accompanying drawings.

IN THE DRAWINGS

FIG. 8 is a frontal view of the tail stock showing a portion of a length of corrugated pipe thereon.

DESCRIPTION OF THE PREFERRED EMBODIMENT

Figure 5:
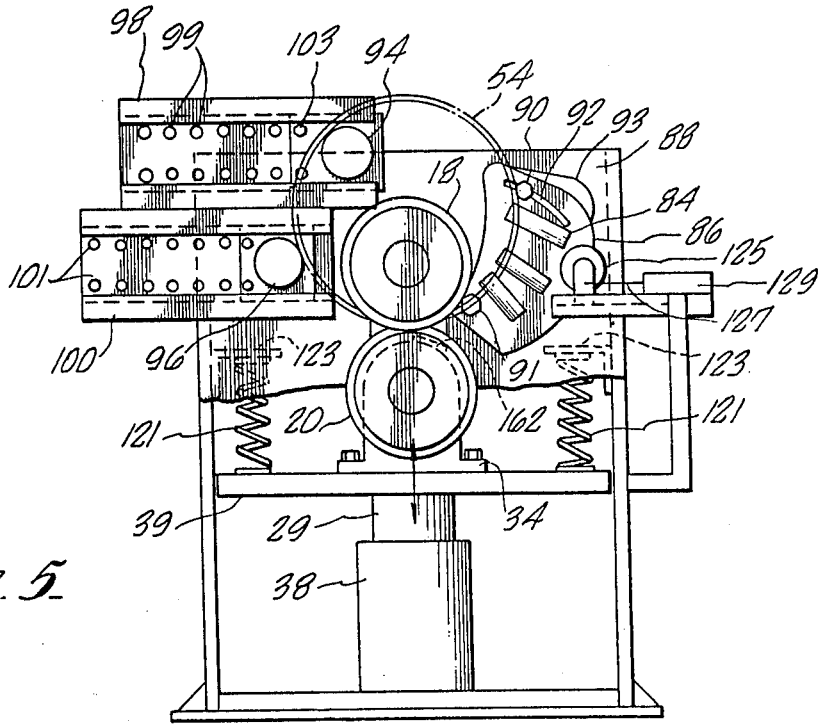
FIG. 5 is a frontal view of the head stock.

Referring now in detail to the drawings, the flanging assembly 10 is comprised of a head stock 12, central pipe support 14 and tail stock 16. The head stock, shown most clearly in FIGS. 1 and 3, includes an upper roller 18 lower roller 20 and drive motor 22. The upper and lower rollers 18 and 20 have annular corrugations 24 on the surfaces thereof to apply annular corrugations to the end of the pipe length being flanged, and are mounted on shafts 26 and 28 respectively. Drive shaft 26 is rotatably mounted and supported in a pair of fixed pillow blocks 30 and 31 and is mechanically linked to the drive motor 22 by a chain drive mechanism 32, whereby the upper roller 18 can be driven in either a clockwise or counterclockwise direction, as viewed from the central pipe support 14. Lower shaft 28, which carries the lower roller 20, is journaled at the forward end thereof in support 34 and at its rearward end in a self aligning pillow block 36. The lower shaft 28 carries a gear 35 thereon which meshes with a gear 37 carried by the upper drive shaft 26, whereby the lower roller 20 is driven in the opposite direction of roller 18. As seen in FIG. 5, the forward lower shaft support 34 is carried by and secured to a transverse support bar 39 which is, in turn, carried by a hydraulic piston 29 disposed within and extending upwardly from a fixed cylinder 38. The hydraulic piston is operable to raise and lower the transverse support bar 39 and lower shaft support 34 and thereby correspondingly raise and lower the lower roller 20 into and out of the operative position, as will be described. The self aligning pillow block 36, in which the rearward end of the lower shaft is journaled, allows that end to undergo the necessary travel caused by the hydraulic piston 29.

Figures 1, 2, 3:
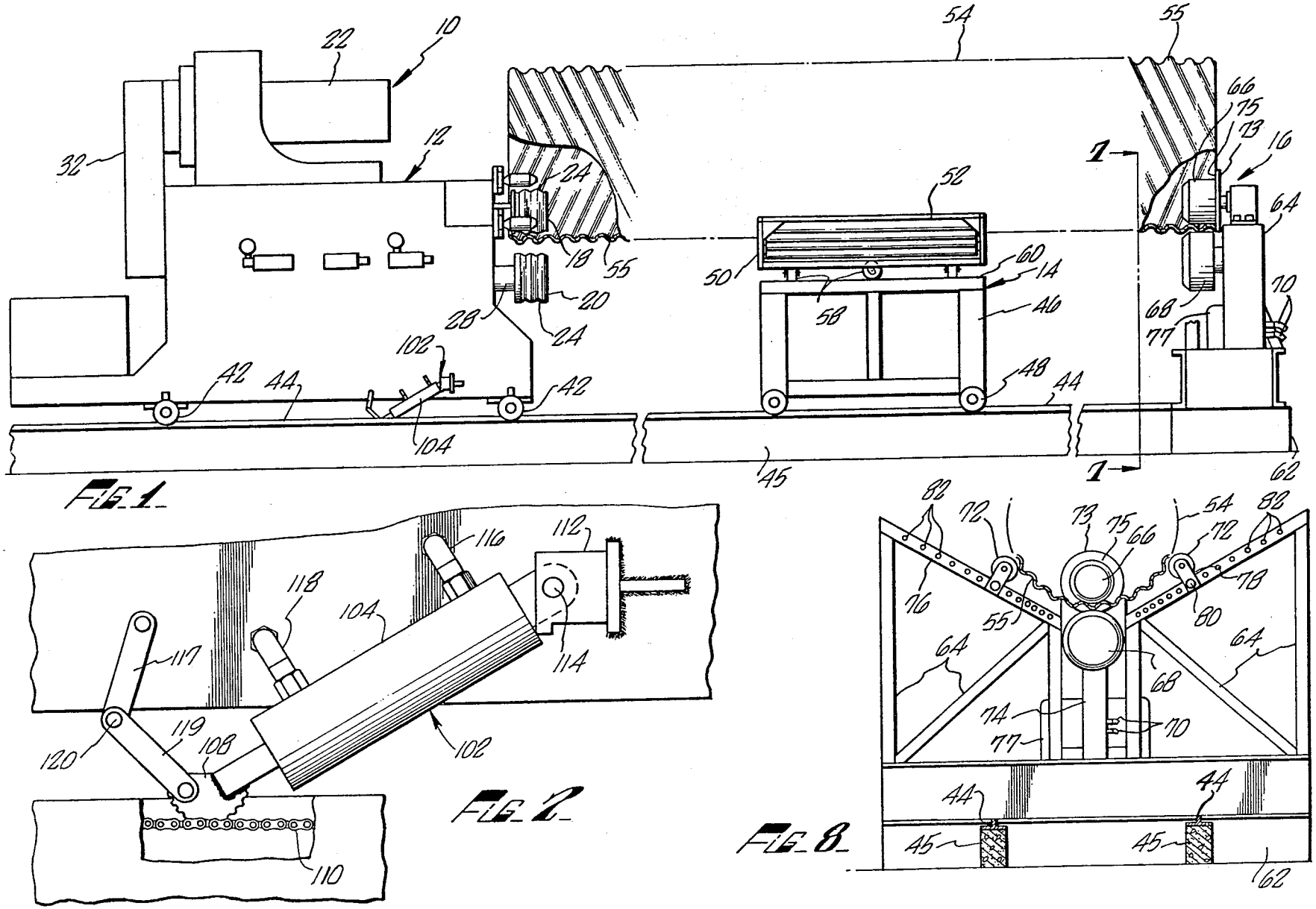
FIG. 1 is a partial sectional side view of the flange forming assembly with a length of spirally wound corrugated pipe positioned thereon.
FIG. 2 is an enlarged view of the head stock locking mechanism.
FIG. 3 is a sectional view of a portion of the head stock illustrating the recorrugating and flanging rollers and drive and lifting mechanisms.
Figure 3:
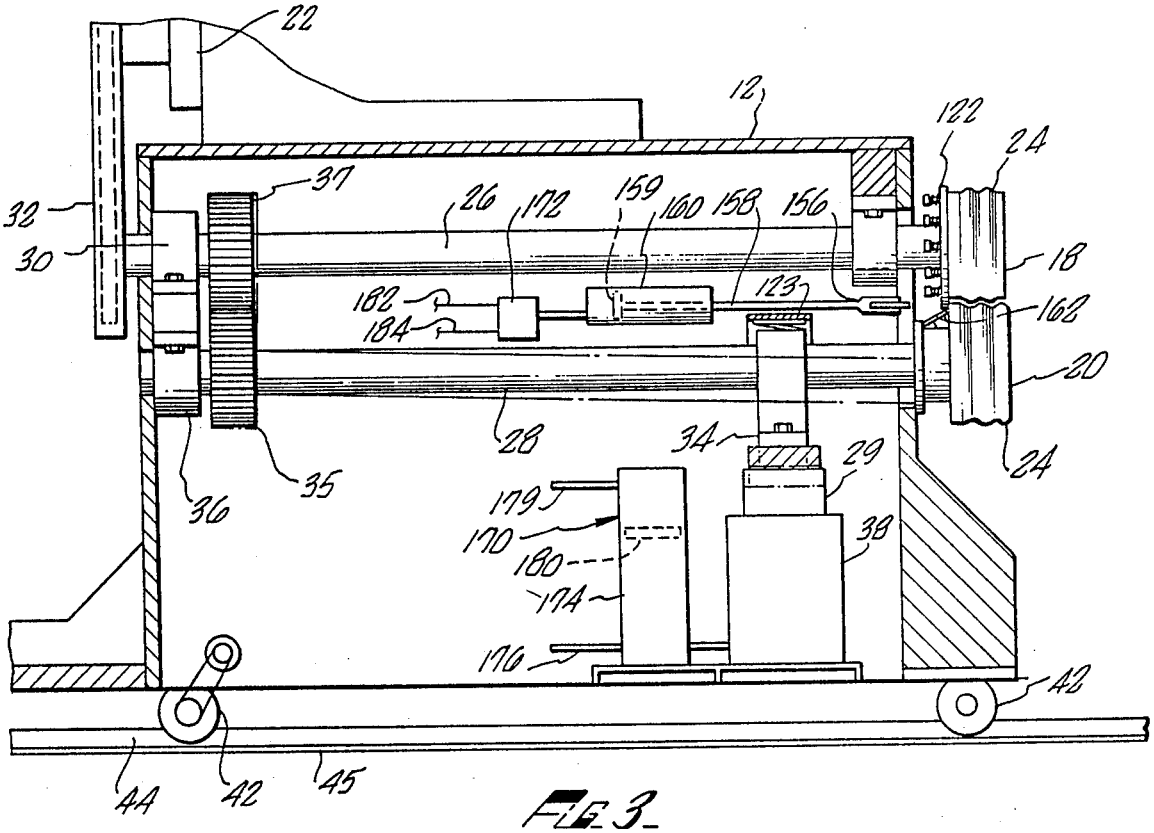

As seen in FIGS. 1 and 3, the head stock 12 is supported by wheels 42 which freely ride on a track 44 which is illustrated mounted on raised concrete supports 45. The central pipe support 14 also rides on track 44 and is comprised of a frame 46, wheels 48 and turntable 50. The turntable has a plurality of elongated support rollers 52 thereon for supporting a length of pipe 54 having spirally formed corrugations 55 therein. The turntable is, in turn, pivotally mounted on the frame 46 by a central pivot (not shown) and is supported thereon by a plurality of pivotally mounted wheels 58 which ride on a flat support surface 60. Rotational mounting of the turntable with respect to the frame allows the turntable to be rotated to facilitate loading a length of pipe thereon and to bring the other end of the pipe into engagement with the head stock after the first end has been flanged. As will become apparent, several different embodiments of a central pipe support could be employed with the present invention, and support 14 is merely illustrative of one such embodiment.

The tail stock 16, as shown in FIGS. 1 and 8, is rigidly mounted on a base 62 at one end of track 44 and is comprised of a frame 64, an upper support roller 66, a lower support roller 68 and lateral pipe support rollers 72. In the presently preferred construction of the tail stock, the lower roller 68 is rotatably mounted on the frame 64 in a fixed position. The upper support roller 66 has an enlarged base portion 73, defining a pipe contact surface 75 and is mounted on a hydraulic lifting mechanism 74 which is operable via hydraulic lines 70 to raise and lower the upper support roller to selectively engage the end of a length of pipe. The lateral pipe support rollers 72 are mounted on angle arms 76 of the frame by means of brackets 78 and bolt means 80. A plurality of apertures 82 are provided in each angle arm so that the lateral support rollers can be properly positioned along the angle arms according to the diameter of the length of pipe being flanged to properly support the pipe on the exterior surface thereof, as shown in FIG. 8.

In operation, a length of spirally wound corrugated pipe 54 is positioned on the elongated support rollers 52, the central pipe support 14. The turntable 50 is then rotated, bringing the pipe into alignment with the flanging assembly. The central pipe support is then moved along track 44 until one end of the pipe abuts the pipe contact surface 75 of the upper support roller 66 on the tail stock 16, the remainder of the roller being disposed inside the length of pipe 54, as shown in FIGS. 1 and 8. The lateral pipe support rollers are disposed along the angle arms 76 of the frame to abut the outer surface of the pipe. The hydraulic lifting mechanism 74 is then actuated to lower the upper support roller 66 into contact with the pipe. In this position, the pipe length abuts contact surface 75 of the upper support roller and is in gripping contact with the surfaces of the upper and lower support rollers 66 and 68 and the lateral pipe support rollers 72. It has been found desirable, although not necessary, to provide the tail stock with a motor 77 to drive the lower support roller 68 and thereby assist in rotating the pipe length and reduce any twisting of the pipe length which might occur if the pipe length were driven solely at one end thereof. To provide a better gripping surface the lower support roller 68 is preferably constructed of polyurethane and in the preferred operation of the tail stock, the lower roller is driven slightly faster (about 10%) than the head stock rollers to impart rotational momentum to the pipe length.

After the pipe length has been secured to the tail stock 16, the head stock 12 is moved along track 44 into engagement with the other end of the pipe length which is to be flanged, as shown in FIGS. 1 and 5. The head stock is provided with a plurality of thrust rollers 84 which are angularly disposed and rotatably mounted on a plate 86. Plate 86 is secured to the facing 88 of the head stock 16 by bolt means 90 and 91 and is provided with an adjusting slot 92, so that the plate may be pivoted about bolt means 90 to properly dispose the thrust rollers for pipes of varying diameters. In addition, a plurality of shims 93 are disposed between the plate 86 and head stock facing 88 to allow the pipe to be moved varying distances onto the recorrugating and flanging rollers and thereby varying the length of the flange which will be formed, as will be described.

The head stock facing 88 is also provided with an internal containing roller 94 and an external containing roller 96 which are mounted in elongated brackets 98 and 100, respectively. Brackets 98 and 100 are each provided with a plurality of apertures 99 and 101, respectively, so that the positioning of the containing rollers can be adjusted to pipe lengths of varying diameters and secured to the brackets by bolt means 103. When the head stock 12 is moved into engagement with the pipe length, the upper roller 18 and internal containing roller 94 are disposed within the pipe length and against the inside surface thereof. The external containing roller 96 is disposed against the external surface of the pipe length and the lower roller 20 is disposed below and out of contact with the external surface of the pipe length. The head stock is then locked in place by the hydraulically actuated securing means 102 shown in FIGS. 1 and 2.

The securing means is comprised of a hydraulic cylinder 104, piston (not shown), ratchet 108 and locking chain 110. The cylinder is pivotally secured to the head stock by bracket 112 and locking pin 114 and communicates with a supply of hydraulic fluid though lines 116 and 118. The ratchet 108 is also pivotally secured to the head stock by means of lever arms 117 and 119 which are pivotally joined by pin 120. When hydraulic fluid is introduced into the hydraulic cylinder through line 116, the piston is driven downwardly, locking the ratchet in chain 110 which runs parallel with the track 44. When the ratchet is held within the locking chain by the force of the hydraulic fluid on piston 106, the head stock is firmly held in place on track 44.

After the head stock has been urged into position and secured, the hydraulic piston 29 is activated to raise the lower roller 20 into contact with the underside of pipe 54 and press the underside of the pipe against the upper roller 18. In the inactivated state, the lower roller 20 is biased downwardly by the weight thereof and coil springs 121 which are disposed on either side of the lower shaft-support 34 and piston 29 and secured at their upper ends by stops 123 and press against the transverse support bar 39 on which the lower shaft support 34 is carried. Upon activation of the hydraulic piston 29, the pressure exerted on the pipe by the lower roller 20 depends on the gauge of the pipe length being flanged. With 16 gauge steel (0.162 cm in wall thickness), a pressure of about 28 to 29.75 kg/cm$^2$ (400 to 425 psi) has been found to be desirable; with 14 gauge steel (0.20 cm), 35 to 36.75 kg/cm$^2$ (500 to 525 psi); and with 12 gauge steel (0.277 cm), 42 to 42.75 kg/cm$^2$ (600 to 625 psi).

As the lower roller 20 is raised to press the pipe against the upper roller 18, hydraulically actuated containment roller 125 mounted on the head stock (see FIG. 5) is urged into contact with the exterior surface of the pipe length by means of a piston rod 127 extending from a hydraulic cylinder 129. Roller 125 together with the internal and external containing rollers 94 and 96 hold the pipe securely in place as it is recorrugated and flanged by rollers 18 and 20 and the additional apparatus which will be presently described.

Figure 7:
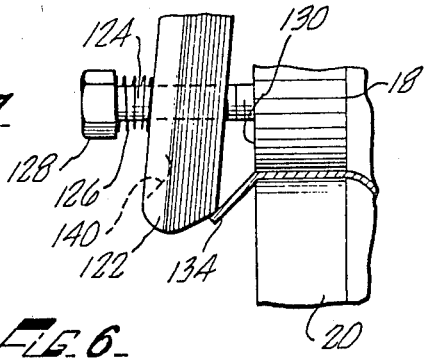
FIG. 7 is a side view of the rollers and ironing plate in the initial flange forming stage.

As again viewed from the central pipe support 14, when the drive motor 22 is activated, the upper roller 18 is driven in a clockwise direction, causing the lower roller 20 to rotate in a counterclockwise direction, whereby the pipe length 54 disposed therebetween is caused to rotate in a clockwise direction. During rotation, the pipe length is firmly held at its forward end by the upper and lower rollers 18 and 20, containment rollers 94 and 96 and the hydraulically actuated roller 125, while the rear end of the pipe is held by the upper and lower support rollers 66 and 68 and the lateral support rollers 72 of the tail stock. While the foregoing rollers act to precisely position the pipe for the formation of the flange, the central pipe support 14 carries the bulk of the pipe weight. The corrugations 24 in the surfaces of the upper and lower rollers 18 and 20 of the head stock under the pressure of the hydraulic piston 29 detent the forward end of the pipe with its spiral corrugations therein and the rotation of the rollers 18 and 20 reforms the spiral corrugations at the end of the pipe into two annular corrugations 131, illustrated in FIG. 6. The recorrugating of the end of the pipe length into two annular corrugations occurs with one revolution of the pipe. This rotation of the pipe length is directed in a clockwise direction to prevent the pipe length from tending to screw away from the head stock due to the spiral corrugations therein. During this revolution, the forming of the flange is also begun. The upper roller 18 has an ironing plate 122 (see FIGS. 6 and 7) secured to the inner end thereof by a plurality of bolt means 124. A suitable biasing means urges the plate against the upper roller. As shown in the drawings, springs 126 are disposed about the bolts and extend between the enlarged heads 128 thereof and the inner surface 130 of the roller 18 to urge the plate 122 against the roller. During the clockwise revolution of the pipe length 54, the ironing plate is disposed outwardly from the inner surface 130 of roller 18 by the force exerted thereon by the end of the pipe length, as seen in FIG. 7. The pressure exerted by the plate, however, is sufficient to flare the end of the pipe outwardly at an angle of about 45° and thereby initiates the formation of the flange 134. The length of the forming flange 134 is determined by the distance the pipe length extends beyond the lower roller 20 and can be easily adjusted by the number of shims 93 disposed behind the plate 86 which carries the thrust rollers 84 on the face of the head stock 12; the greater the distance the thrust rollers protrude from the face of the head stock, the shorter the flange.

Figure 9:
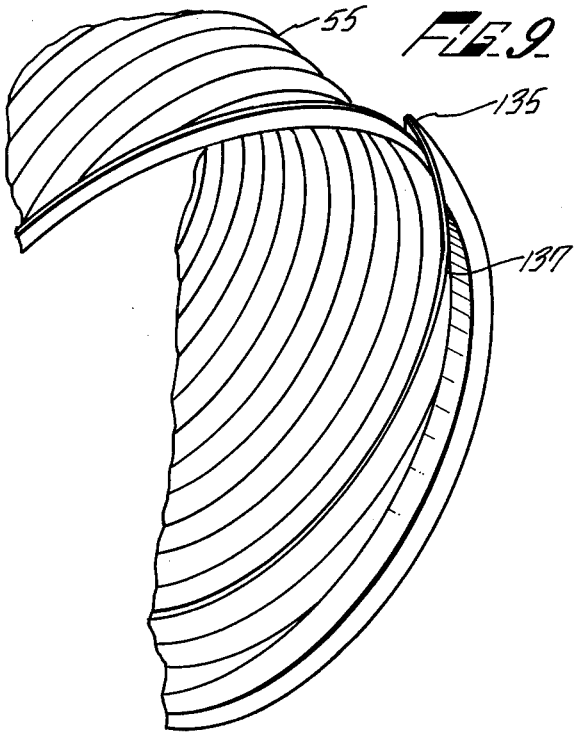
FIG. 9 is a perspective view of a length of pipe being flanged according to the present invention illustrating the spear which is formed at the lock seam of the pipe during flanging.

After a single revolution of the head stock rollers and consequently pipe length 54 during which the annular corrugations are imparted to the pipe length and the formation of the end flange begun, the direction of rotation of the rollers 18 and 20 is reversed, causing the pipe length to rotate in a counterclockwise direction. This reversal of the direction of rotation prevents the shearing wheel 162 which trims the formed flange, as will be discussed, from catching on a spear 135 (see FIG. 9) which is created at the lock seam 137 during the forming of the flange as a result of the deformation of the seam. This spear is angled outwardly of the flange and pointed toward the shearing wheel 162. If rotation of the pipe length were to continue in a clockwise direction, the spear tends to catch on the shearing wheel as well as the thrust rollers 84, and tears the flange.

Figure 4:
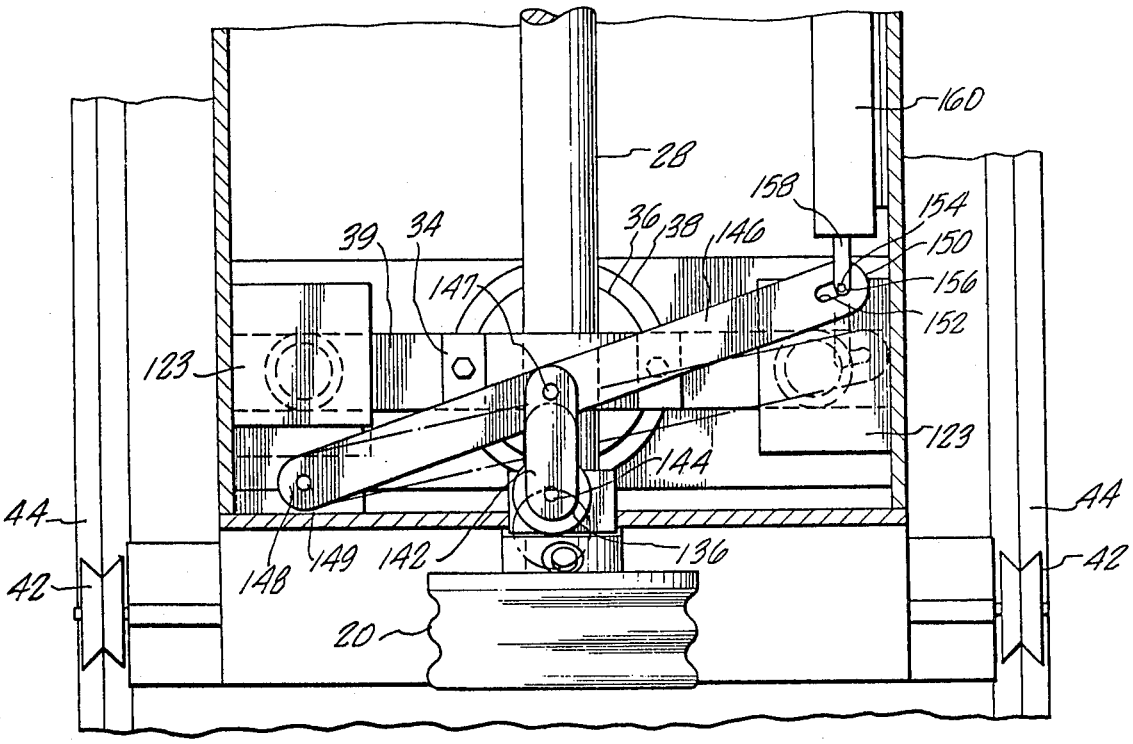
FIG. 4 is a partial sectional view of the head stock illustrating the ironing wheel mounting assembly.

Upon reversal of the direction of rotation, an ironing wheel 136 (see FIGS. 4 and 6) is hydraulically actuated to push the ironing plate 122 against the forming flange 134 and press the flange flat against the inner surface 138 of the lower roller 20. The ironing plate has an annular channel 140 therein to receive the ironing wheel which is journaled in the forward end of a mounting arm 142 and affixed thereto by a pin 144. The mounting arm 142 is pivotally secured to a transverse actuating arm 146 (see FIG. 4) by a pin 147, which, in turn, is pivotally secured at the forwardly extending end 148 thereof to the head stock by pin 149. The rearwardly extended end 150 of the actuating arm has a slot 152 therein through which a pin 154 extends and which, in turn, is secured at its extended ends to a yoke 156 defined by the end of a piston rod 158. The piston rod terminates in a piston head 159 disposed within a hydraulic cylinder 160. The cylinder is in fluid communication within a pressurized supply of hydraulic fluid (not shown) via a conduit 161 and a pressure regulator 172 which will be described. Actuation of the piston rod causes the actuating arm 146 to pivot about pin 149 and thereby extend the ironing wheel 136 from its retracted position, shown in solid lines in FIG. 4, to its extended or actuated position, shown in FIG. 6 and in phantom lines in FIG. 4, whereupon the flange, including the outwardly extending spear 135 at the lock seam, is pressed flat against the inner surface 138 of the lower roller 20. To prevent the ironing wheel from catching on the edges of the annular channel 140 in the lower roller and in order that the flange 134 can be ironed flat prior to the perimeter portion thereof being engaged by a shearing wheel 162, the ironing wheel is mounted about two centimeters (about 0.75 in.) to the left of the central axis of the upper and lower rollers 18 and 20, as viewed from the front of the head stock.

Figure 6:
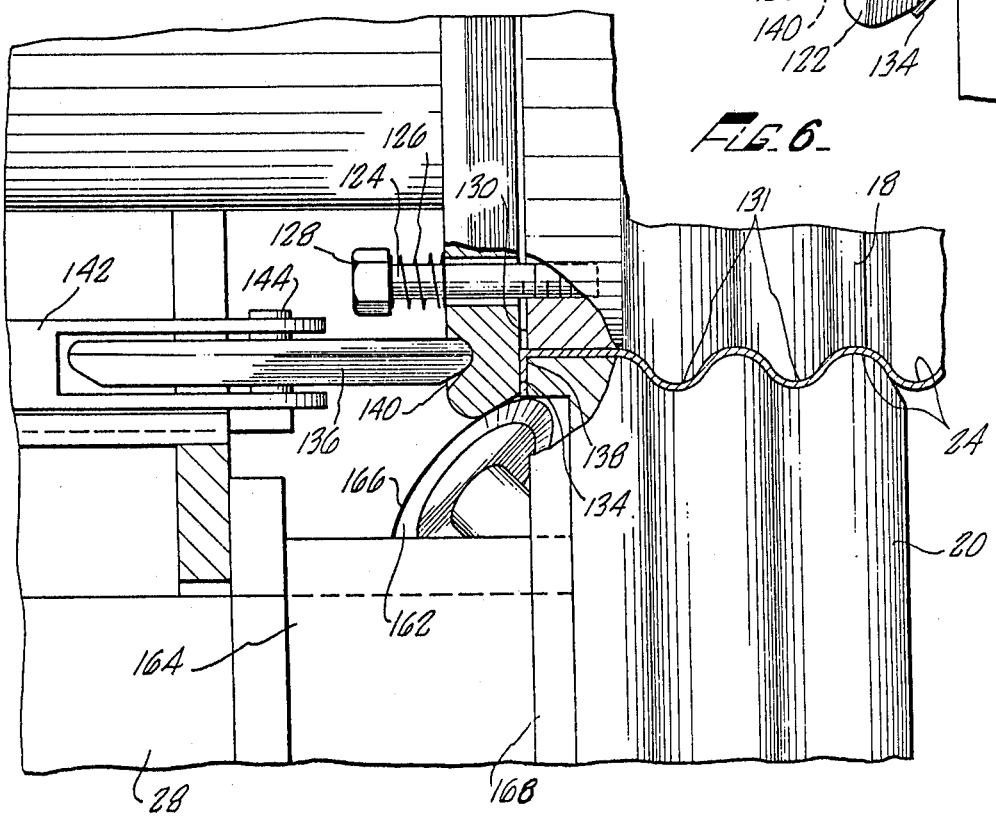
FIG. 6 is an enlarged sectional view of the recorrugating and flanging rollers, ironing plate and wheel and shearing wheel.

While the above mechanism forms an annular flange which extends radially from one end of the pipe, the helical formation of the pipe and deformation involved in creating the flange produces a very irregular flange perimeter. Accordingly, a shearing wheel 162 is angularly and rotatably mounted inwardly of the lower recorrugating and flanging roller 20 on a block 164 carried by lower shaft 28, as seen in FIGS. 5 and 6. The wheel has an annular cutting edge 166 which extends about a half a centimeter into an annular recessed area 168 in the lower roller. While the ironing wheel is mounted to the left of center, the shearing wheel is angularly mounted to the right of center with the cutting edge thereof being on center with respect to the upper and lower rollers 18 and 20, such that when the ironing wheel is actuated to press the ironing plate and forming flange against the inner surface 138 of the lower roller 20, the shearing wheel avoids interfering with the ironing process and severs the excess material from the formed flange including the spear which, due to the reversal of the direction of rotation, is now effectively backed into the shearing wheel and neatly trimmed to provide an annular flange of substantially uniform radial dimension.

While the hydraulic assemblies which raise the upper and lower head stock rollers 18 and 20, the upper support roller 66 on the tail stock, actuate the ironing wheel, laterally dispose the pipe containment roller 125 and secure ratchet 108 to the locking chain 110, all operate in a standard fashion, the hydraulic assemblies which drive piston 29 to raise and lower the lower roller 20 and that which actuates the ironing wheel include pressure-relief mechanisms or accumulators 170 and 172, respectively. A pressure-relief mechanism is necessary to accommodate the varying thickness of the end of the length of spirally wound corrugated pipe. This thickness varies from a single ply of the particular gauge of pipe to four such thicknesses at the lock seam. If such a relief mechanism were not provided, the pressure exerted by the lower roller against the pipe length would flatten the lock seam because of the increased thickness thereof and cause breakage. It is therefore necessary to provide a mechanism to allow the lower roller to back off to accommodate this increase in pipe thickness.

The pressure-relief mechanism 170 incorporated herein is best seen in FIG. 3 and includes a hydraulic cylinder 174, the lower end of which is filled with hydraulic fluid through inlet 176 from a pressurized supply (not shown) and is in fluid communication through conduit 178 with lifting cylinder 38 for raising the lower roller 20. A piston 180 is operably disposed within cylinder 174 and the area within the cylinder above the piston is filled with a compressible gas such as nitrogen via conduit 179. In use, the compressible gas within cylinder 174 is pressurized to a given psi through conduit 176, depending on the gauge of pipe being flanged. This pressure corresponds to that to be exerted by the lower roller 20 on the pipe, so if 16 gauge pipes were being used, the gas would be pressurized to about 28 to 29.75 kg/cm$^2$ (400 to 425 psi). When the lower roller 20 strikes a second layer of metal, the pressure exerted by the roller on the pipe would rise above the 28 to 29.75 kg/cm$^2$ level, were it not for the compressible gas within cylinder 174, which would then be compressed by the piston 180 and thereby relieve the pressure on piston 29 within the lifting cylinder 38 and allow the piston to back off the amount necessary to maintain the desired pressure or limited pressure range against the end of the pipe length being flanged. In this manner, the lower roller 20 continually maintains the desired pressure range on the pipe, regardless of the varying thickness in the wall thereof. As noted above, a similar mechanism is preferably provided for the hydraulic system for actuating the ironing wheel to prevent undue pressure from being exerted on the formed flange 134. This mechanism generally includes a hydraulic cylinder 173 having fluid inlets 182 and 184 on either side of a piston head disposed therein (not shown) and a conduit 161 communicating the cylinder with hydraulic cylinder 160.

Figure 10:
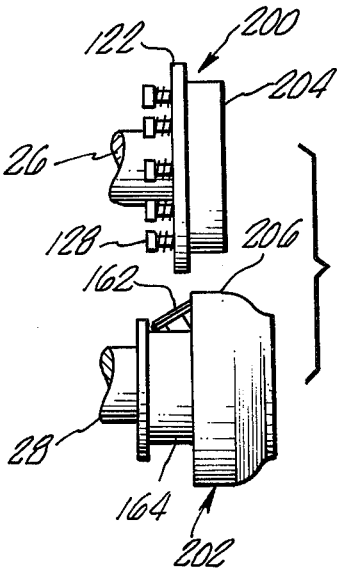
FIG. 10 is a side view of a second embodiment of the rollers which avoid recorrugating the ends of the pipe.

FIG. 10 illustrates another embodiment of the head stock rollers. The rollers 200 and 202 shown therein differ from the upper and lower rollers 18 and 20 in the prior embodiment in that they do not have corrugations in the surfaces thereof. As discussed above, the annular corrugations 24 in the surfaces of rollers 18 and 20 apply corresponding annular corrugations to the end of the pipe length being flanged. While annular corrugations adjacent a radial end flange increase the flexibility of the pipe length in that it could then be used with both the channel-type band coupler and, because the flange is formed at a valley in the corrugations, with a conventional band or split band coupler as well. However, if the pipe length is to be used solely with the channel-type coupler, the annular corrugations are not needed. By varying the configurations of the head stock rollers, sufficient gripping contact with the pipe length can be maintained to flange the end of the pipe as described above without recorrugating.

Figure 11:
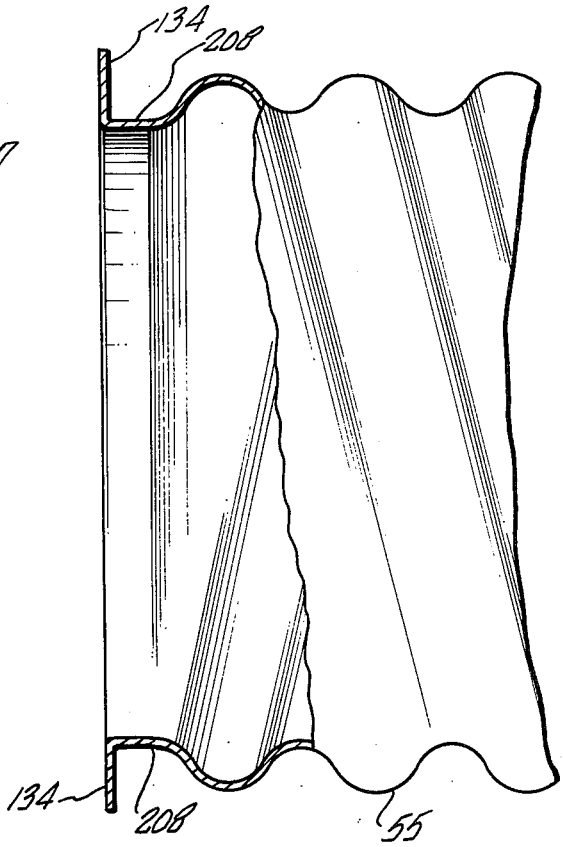
FIG. 11 is a side view of a pipe length flanged with the rollers illustrated in FIG. 10.

To avoid recorrugating the end of the pipe length to be flanged, the upper roller 200, as rollers 18 and 20, is preferably constructed of hardened steel and defines a constant radius contact surface 204 of about 3.2 cm (1.25 in.) in length (see FIG. 10). The lower roller 202, also constructed of hardened steel, has a slightly raised base portion 206 (also found on roller 18) which mates with the contact surface 204 on the upper roller 200. Rollers 200 and 202 are mounted on shafts 26 and 28 respectively and are operated in the same manner as head stock rollers 18 and 20. During a flanging operation with rollers 200 and 202 mounted on the head stock 12, the raised base portion 206 of the lower roller presses the end of the pipe length adjacent the forming flange against the contact surface 204 of the upper roller to form that portion of the pipe length held therebetween into a narrow band 208 of constant radius which is illustrated in FIG. 11.

Figure 12:
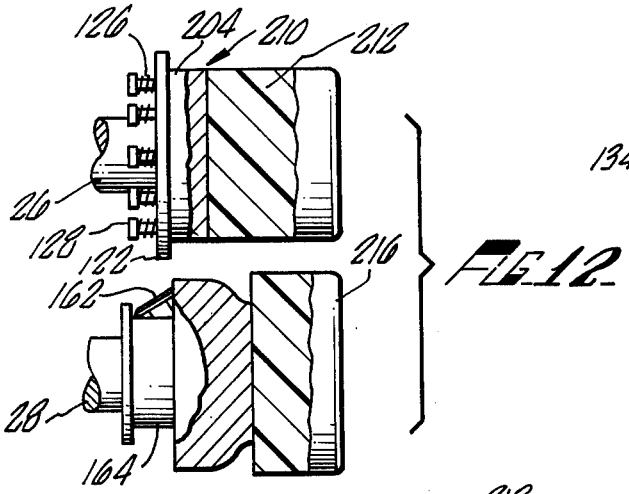
FIG. 12 is a side view of a modified form of the rollers.

In certain instances, it has been found desirable to provide the pipe length with a polymer coating to prevent the galvanized steel from which such pipe lengths are generally constructed from corroding. Such a coating is frequently used in areas wherein the soil is highly alkaline or acidic. When providing a radial end flange on coated pipe, greater difficulty is encountered in obtaining the necessary gripping contact of the pipe length with the head stock rollers. Consequently, slippage occurs which tends to strip the coating from the pipe. FIG. 12 illustrates a third embodiment of the head stock rollers capable of gripping and turning a coated length of pipe without recorrugating the end thereof or damaging the pipe's protective coating. As seen therein, the upper roller 210 is similar to roller 200 of the prior embodiment except that it includes an extension 212, also of constant radius and preferably constructed of a slightly deformable material such as polyurethane which is secured thereto and extends therefrom. The extension 212 is of the same constant radius as contact surface 204 and preferably is about 12.7 cm (5 in.) in length. The lower roller 214 is also similar to roller 202 but, as upper roller 210, is provided with a constant radius extension 216 preferably constructed of the same material as the extension 212 on the upper roller 210 and is about 9 cm (3.5 in.) in length. However, extension 216 has a diameter of about 1.6 to 3.2 cm (0.67 to 1.25 in.) greater than the diameter of the raised base portion 206 thereof. The additional gripping force achieved by the deformable extensions 212 and 216 bearing against the interior and exterior sides of the coated corrugated pipe length allows the end flange 134 to be imparted to the pipe length without damaging the pipe's protective coating. If the coated pipe were to be recorrugated as well as flanged, extensions 212 and 216 could be added onto the ends of rollers 18 and 20. If it is found necessary to provide even greater gripping contact with the pipe length, deformable extensions 212 and 216 can be replaced with longer extensions 218 and 220 as illustrated in FIG. 13.

Figure 13:
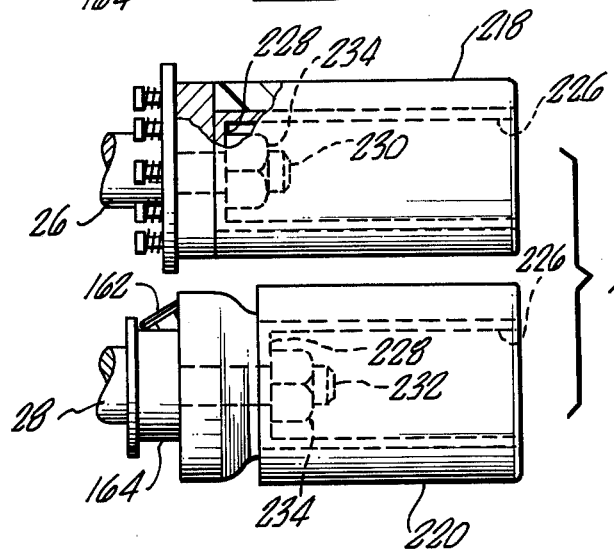
FIG. 13 is a side view of another modified form of the rollers illustrating the manner of securing the deformable extensions to the steel portions of the rollers.

The manner in which the different deformable extensions are secured to the base portions of the rollers and to shafts 26 and 28 is illustrated in dotted lines in FIG. 13. As seen therein, the deformable material of each extension is securely disposed about an interior cylinder 226 which defines an annular flange 228 at the inner end thereof. The ends 230 and 232 of shafts 26 and 28 are of reduced diameter and threaded for engagement with a locking nut 234. The locking nuts press the extensions against the steel portion of the upper roller and base portion of the lower roller and the rollers against the enlarged portion of the shaft 26 and block 164, thereby securing the extensions to the rollers and the rollers to the shafts.

Various changes and modifications may be made in carrying out the present invention without departing from the spirit and scope thereof. Insofar as these changes and modifications are within the purview of the appended claims, they are to be considered as part of the invention.

I claim:

1. An apparatus for flanging a length of spirally corrugated pipe which comprises: means for supporting said pipe lengths; and a flanging assembly, said assembly including a pair of rollers for gripping one end of said pipe length, means for driving said rollers to turn said pipe length in a given direction, means for flaring said end of said pipe length outwardly therefrom, means for driving said rollers to turn said pipe length in an opposite direction, means for converting said outwardly flared end of said pipe length into a substantially perpendicular disposition with respect to the longitudinal axis of said pipe length thereby forming a radial end flange.

2. The combination of claim 1 including means for trimming the perimeter portion of said radial end flange as said pipe is driven in said opposite direction to provide a substantially uniform radial end flange.

3. An apparatus for flanging a length of spirally wound corrugated pipe which comprises: means for supporting said pipe length; and a flanging assembly, said assembly including a pair of rollers for gripping one end of said pipe length, means for driving said rollers to turn said pipe length, means for flaring said end of said pipe length outwardly therefrom; forming means for converting said outwardly flared end of said pipe length into a substantially perpendicular disposition with respect to the longitudinal axis of said pipe length thereby forming a radial end flange, and means for trimming the perimeter portion of said radial end flange to provide a substantially uniform radial dimension.

4. The combination of claim 3 wherein one of said rollers has a contact surface of substantially constant radius, and the other of said rollers has an annular raised base portion adapted to press a portion of said pipe length against said surface and maintain gripping contact therewith.

5. The combination of claim 3 wherein one of said rollers is adapted to be disposed within said length of pipe and the other of said rollers is adapted to be exposed exteriorly of said length of said pipe and including means for drawing one of said rollers to the other of said rollers to bring the surfaces thereof into gripping contact with said pipe length and means responsive to the thickness of said pipe length for continually maintaining said gripping contact within a predetermined pressure range during rotation of said rollers.

6. The combination of claim 3 wherein said flaring means comprises a plate member carried by one end of one of said rollers and means for biasing said member toward said end of said one of said rollers, said plate member extending over a portion of the other of said rollers upon said rollers being disposed in a pipe gripping relationship and said biasing means urging said member against said end of said pipe length and flaring said end outwardly therefrom.

7. The combination of claim 3 including means for drawing said rollers into gripping contact with one end of said pipe and means for continuously maintaining said contact within a predetermined pressure range during rotation of said rollers, said constant pressure maintaining means comprising a cylinder having a piston operable therein, the area within said cylinder on one side of said piston containing hydraulic fluid and being in communication with said drawing means and the area within said cylinder on the other side of said piston containing a compressible gas, and means for regulating the pressure of said gas within said cylinder.

8. The combination of claim 4 wherein at least one of said rollers is provided with an extended pipe gripping surface, said surface having a uniform radius and being constructed of a deformable material such that upon said pipe length being driven by said rollers said extended surface maintains a gripping contact with the corrugation on said pipe length while avoiding deformation thereof.

9. The combination of claim 6 wherein said converting means comprises a support member, an ironing wheel journaled in said support member, and means for moving said wheel into engagement with said plate and pressing said plate against said end of said plate carrying roller, thereby pressing the flared end of said pipe length against said contact surface to form said radial end flange.

10. The combination of claim 8 wherein each of said rollers are provided with extended gripping surfaces constructed of a deformable material, the surface extending from said roller having said contact surface having a uniform radius substantially the same as the radius of said surface and the surface extending from said other roller having a uniform radius less than the radius of said base portion such that upon said pipe length being driven by said rollers said extended surfaces are in gripping contact with the corrugations in said pipe length while avoiding deformation thereof.

11. An apparatus for flanging a length of spirally corrugated pipe which comprises: means for supporting said pipe length; a flanging assembly including an upper roller adapted to be disposed within said pipe length, a lower roller adapted to be disposed exteriorly of said pipe length, means for raising said lower roller to bring the surfaces of said rollers into a gripping contact with one end of said pipe length, means for driving said rollers, means carried by one of said rollers for flaring said end of said pipe length outwardly therefrom, means for converting said outwardly flared end of said pipe length into a substantially perpendicular disposition with respect to the longitudinal axis of said pipe length, thereby forming a radial end flange, means responsive to the thickness of said pipe length for maintaining said gripping contact within a predetermined pressure range during rotation of said rollers, and means for trimming the perimeter portion of said flange to provide said flange with a substantially uniform radial dimension.

12. The combination of claim 11 wherein one of said rollers has a contact surface of substantially constant radius, and the other of said rollers has an annular raised base portion adapted to press a portion of said pipe length against said surface and maintain gripping contact therewith.

13. The combination of claim 11 wherein said flaring means comprises a plate member carried by and biased toward one end of one of said rollers, the other of said rollers defining a flange forming contact surface, said plate member extending radially from the first of said rollers and over at least a portion of said contact surface of said other roller.

14. The combination of claim 12 wherein each of said rollers are provided with extended gripping surfaces constructed of a deformable material, the surface extending from said roller having said contact surface having a uniform radius substantially the same as the radius of said surface and the surface extending from said other roller having a uniform radius less than the radius of said base portion such that upon said pipe length being driven by said rollers said extended surfaces are in gripping contact with the corrugations in said pipe length while avoiding deformation thereof.

15. The combination of claim 12 wherein said converting means comprises a support member, an ironing wheel journaled within said support member and means for moving said wheel into engagement with said plate and pressing said plate against said end of said plate carrying roller thereby pressing the flared end of said pipe length against said contact surface to form said radial end flange.

16. An apparatus for flanging a length of spirally corrugated pipe without recorrugating the ends thereof which comprises: means for supporting said pipe length and a flanging assembly, said flanging assembly including a pair of rollers for gripping one end of said pipe length, one of said rollers having a contact surface of substantially constant radius, said surface being constructed of a deformable material, means for driving said rollers to turn said pipe length, means for flaring said end of said pipe length outwardly therefrom, and forming means for converting said outwardly flared end of said pipe length into a substantially perpendicular disposition with respect to the longitudinal axis of said pipe length thereby forming a radial end flange.

17. The combination of claim 14 wherein said deformable material is polyurethane.

18. The combination of claim 16 including means for trimming the perimeter portion of said radial end flange as said pipe length is turned by said rollers to provide a substantially uniform radial dimension.

19. An apparatus for flanging a length of spirally corrugated pipe without recorrugating the ends thereof which comprises: means for supporting said pipe length and a flanging assembly, said assembly including a pair of rollers for gripping one end of said pipe length, one of said rollers having a contact surface of substantially constant radius, said surface being constructed of a deformable material, means for driving said rollers to turn said pipe length in a given direction, means for flaring said end of said pipe length outwardly therefrom as said pipe length is turned in said given direction, means for driving said rollers to turn said pipe length in an opposite direction, means for converting said outwardly flared end of said pipe length into a substantially perpendicular disposition with respect to the longitudinal axis of said pipe length as said pipe length is turned in said opposite direction to form a radial end flange, and means for trimming the perimeter portion of said radial end flange as said pipe length is driven in said opposite direction to provide a substantially uniform radial dimension.

20. A method for flanging a length of spirally corrugated pipe comprising the steps of turning said pipe length in a given direction; flaring said end of said pipe length outwardly therefrom; turning said pipe length in the opposite direction; converting said outwardly flared end of said pipe length into a substantially radial outwardly extending end flange; and trimming the perimeter portion of said end flange to provide it with a substantially uniform radial dimension.

21. A method of flanging a length of spirally corrugated pipe comprising the steps of turning the pipe length about a fixed axis in a given direction and concurrently flaring said end of said pipe length outwardly therefrom; turning said pipe length about said axis in the opposite direction and concurrently converting said outwardly flared end of said pipe length into a substantially radial outwardly extending end flange; and trimming the perimeter portion of said flange to provide it with a substantially uniform radial dimension while said pipe length is being turned in said opposite direction.

22. A method for flanging a length of spirally corrugated pipe comprising the steps of turning a portion of said pipe length adjacent one end thereof in a given direction between a pair of rollers; continually maintaining said rollers against said pipe length at a pressure within a predetermined range; flaring said end of said pipe length outwardly therefrom; turning said portion of said pipe length between said pairs of rollers in the opposite direction; converting said outwardly flared end of said pipe length into a substantially radial outwardly extending end flange; and trimming the perimeter portion of said flange to provide it with a substantially uniform radial dimension.

* * * * *

UNITED STATES PATENT OFFICE

CERTIFICATE OF CORRECTION

Patent No. 4,079,614 Dated March 21, 1978

Inventor(s) Robert E. Hall.

It is certified that error appears in the above-identified patent and that said Letters Patent are hereby corrected as shown below:

The term of this patent subsequent to February 22, 1994 has been disclaimed.

Signed and Sealed this

*Fifth* Day of *September 1978*

[SEAL]

*Attest:*

RUTH C. MASON
*Attesting Officer*

DONALD W. BANNER
*Commissioner of Patents and Trademarks*